United States Patent [19]

Keel

[11] Patent Number: 4,602,431

[45] Date of Patent: Jul. 29, 1986

[54] HAIRCUTTING SHEARS

[76] Inventor: Gayle M. Keel, 8080 Effie Dr., Niagara Falls, N.Y. 14304

[21] Appl. No.: 697,019

[22] Filed: Jan. 31, 1985

[51] Int. Cl.[4] ..... B26B 13/10

[52] U.S. Cl. ..... 30/229

[58] Field of Search ..... 30/230, 229

[56] References Cited

U.S. PATENT DOCUMENTS

| | | | |
|---|---|---|---|
| 2,387,053 | 10/1945 | Brown | 30/230 |
| 2,395,897 | 3/1946 | Kethcart | 30/230 |
| 2,574,066 | 11/1951 | See | 30/230 |
| 2,600,036 | 6/1952 | Wertepny | 30/230 X |
| 2,676,402 | 4/1954 | Shaler | 30/230 |
| 2,677,179 | 5/1954 | Servilla | 30/229 X |
| 2,916,822 | 12/1959 | Weidauer | 30/230 |
| 3,408,875 | 11/1968 | Briskman | 30/230 |
| 4,406,063 | 9/1983 | Zaitz | 30/230 |

*Primary Examiner*—Jimmy C. Peters

*Attorney, Agent, or Firm*—Fay, Sharpe, Fagan, Minnich & McKee

[57] ABSTRACT

A pair of haircutting shears wherein first and second shear blades, associated at a pivot point, contain sinusoidally grooved cutting edges comprising a plurality of wave cycles thereon. The grooved cutting edges are separated from the pivot point by air gaps to prevent the lodging of unsevered hair therebetween during a haircut and provide a smooth or blended overall appearance after cutting. The shears are relatively lightweight for ease of use and allow an improved and more efficient resulting haircut.

2 Claims, 7 Drawing Figures

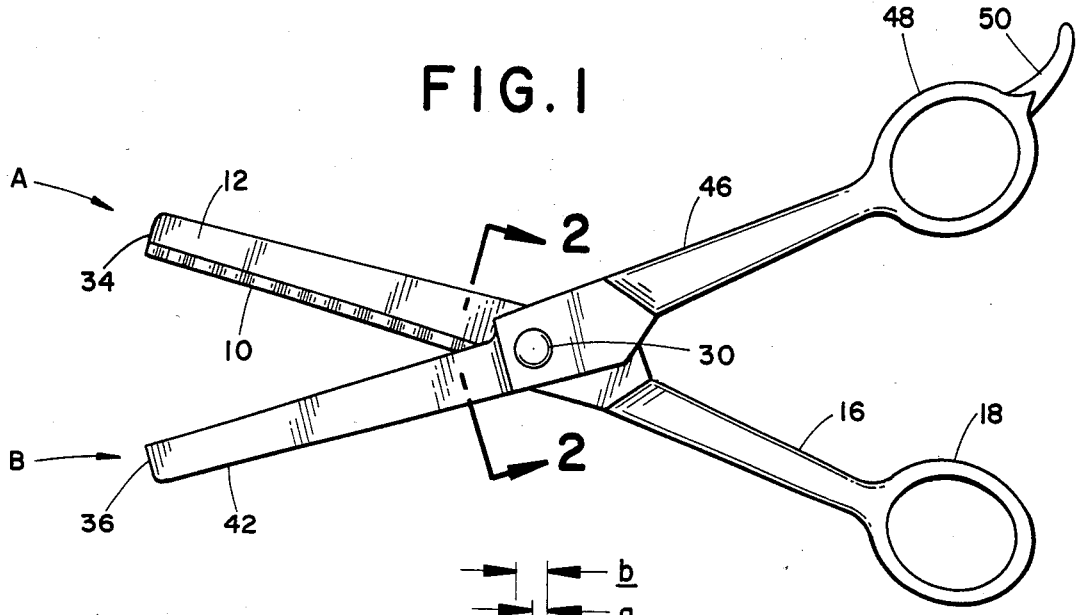
FIG. 1
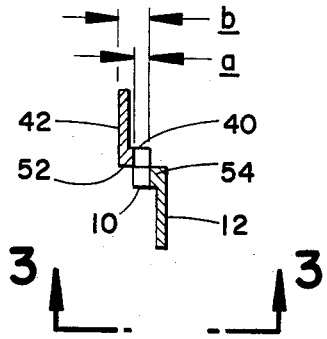
FIG. 2
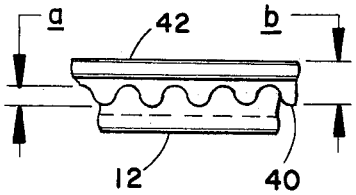
FIG. 3
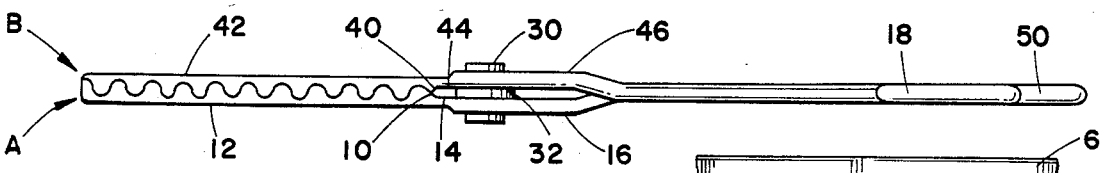
FIG. 4
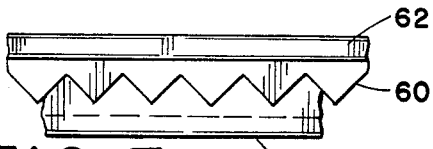
FIG. 7
FIG. 6
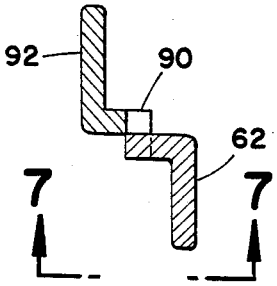
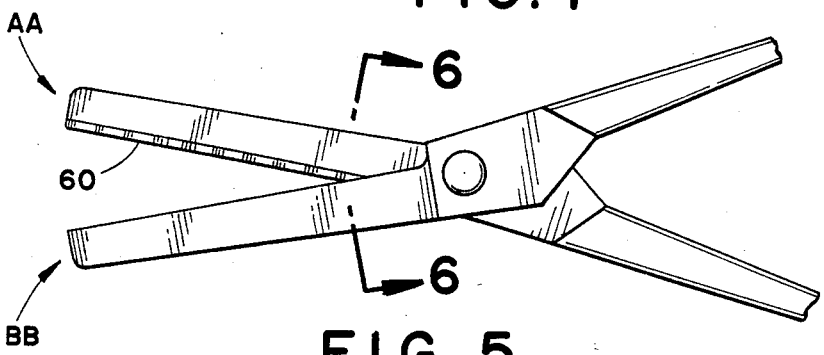
FIG. 5

HAIRCUTTING SHEARS

BACKGROUND OF THE INVENTION

The present invention relates to the art of scissors or shears and more particularly those that are employed in the art of personal haircutting. The invention finds particular application in facilitating the cutting of hair along an irregular line to provide a smoothed or blended overall appearance after cutting.

The traditional tools available to hairdressers, beauticians, and barbers for manual cutting of hair have included both a comb and straight-edge scissors. In a typical haircutting operation, an operator cuts the hair in a series of repetitive, straight linear cuts accomplished by separating a line of hair, usually with a comb, and trimming along a length of that line, resulting in hair of a uniform, preselected length. The next line would be selected from hair above or below the prior cutting line, with the next cut then being repeated in a similar fashion. In this way, the entire scalp might be addressed to achieve hair with a desired length.

If correctly and skillfully done, the above cutting procedure will finally result in a hair look that is substantially blended. If incorrectly done, that is to say if the subsequent lines have not been chosen properly, or if the repetitive lines do not result in hair lengths substantially consistent, the resultant look after a completed cutting is one of steps or discrete lines in the hair. The process of consistently acquiring a smooth appearing final look, requires one to be skilled and knowledgeable in the art. Even if one were to be skilled, however, a relatively small margin of error still leaves a substantial chance for less smoothness in the completed cut than otherwise would be desirable.

With the foregoing conditions in mind, the present invention contemplates a means to substantially lessen the chances of resulting discrete ridges in a completed haircut, while lessening the overall skill necessary to consistently accomplish that result.

A first attempt to remedy some of the above noted problems was made by W. J. Servilla in U.S. Pat. No. 2,677,179. There, a shear with a waved blade was contemplated to result in a cut with less discrete edges than was possible with the use of a straight-edge shear. The Serville disclosure broadly taught the use of waved blades wherein three or less total periods of the wave were present resulting in wave lengths that were substantially in excess of their amplitude, or changes in length of hair along a cutting line. The resultant cut from the Servilla shears, therefore, had substantial chance for overlap with that of a prior or subsequent cut, which could result in the stepped edge the invention sought to eliminate.

Another problem associated with the Servilla shear came with the relative proximity of the cutting blades to the pivot point of the blades. Naturally resultant from the use of a pivot point is that fact that the closer the shear blades is to the pivot point, the less displacement of one blade from its counterpart during cutting. Therefore, when two blades meet close to the point of intersection, and further when the point of intersection is given no gap between the blades, there is a substantial chance that hair still present within the shear at that point will be lodged within the shear and not severed. This may result in a jamming of the shear, and pain to a person whose hair is being cut.

The disclosure of S. Briskman, et al. in U.S. Pat. No. 2,850,803, issued Sept. 9, 1958, disclosed broadly the use of sinusoidally curved cutting blades on a shear. The disclosure of Briskman, et al. is geared to construction of a shear adapted to cutting of cloth and similar material. Its bulk and relative length of the intersection of its first and second blades, where the meshing and cutting action is accomplished, makes it unsuitable for use in hair. The hair could be lodged within the shear and not severed properly if it was attempted to be used therefor. Also, the relative bulk and weight of the shear would make it unsuitable for the repetitive, intricate manipulation necessary for a haircutting procedure.

A substantial demand exists for a shear that will eliminate the problems associated with repetitive linear cuts of hair which cause a stepped or unsmooth appearance. The demand also seeks a lightweight and easily manipulable shear to accomplish this result, with a substantial lessening in the likelihood of a potential painful lodging of uncut hair within a closed shear.

The present invention overcomes the foregoing difficulty and others. It contemplates a shear equal to the task of easily, quickly, and with less skill than heretofore, required, obtaining a substantially smooth appearing haircut.

SUMMARY OF THE INVENTION

In accordance with the present invention an improved haircutting shear is provided. A first blade which includes a sinusoidally shaped cutting edge at one end and a means for gripping the blade at the other end is connected to a second blade with a similar trimming means disposed opposite to a cutting blade which is complementary to the sinusoid on the first cutting blade. Both blades include a gripping means disposed opposite their bladed ends. When the first and second cutting blades are pivoted upon their pivot point, the corresponding sinusoidal cutting edges of the first and second blades are intermeshed providing cutting action. The portions of the blades disposed opposite the sinusoidal cutting edges are essentially smooth and placed essentially closer to the grooved portions of the cutting edges so as to form relatively slim and lightweight blades. The sinusoidally grooved cutting edges define an amplitude and a wave length of the sinusoid.

Pursuant to another aspect of the invention, the amplitude or depth of the sinusoidal cutting edges are less than one-half of the thickness of the blade.

Pursuant to another aspect of the present invention, there are at least eight projections, or wave cycles, formed by each complementary cutting edge of the two blades.

In conformance with yet another aspect of the present invention, an air gap between the sinusoidal cutting edges and the pivot point is provided.

Pursuant to still another aspect of the present invention, the sinusoidally grooved cutting edges are further defined to be sawtooth-shaped.

One advantage of the present invention is that a shear is provided which cuts hair so as to be unlikely to form an edge which is imperceptible among subsequent linear cuts of hair made substantially parallel to the cut with the shear.

Still another advantage is that a gap exists between the first and second cutting blades and a point at which the two blades pivot so as to avoid a possibility of catching of uncut hair between the two blades.

Still yet another advantage of the present invention is that the shears are lightweight and easily manipulable by an operator during a haircutting procedure.

Further advantages of the present invention will become apparent to those of ordinary skill in the art upon a reading and understanding of the following detailed description of the preferred alternate embodiments.

BRIEF DESCRIPTION OF THE DRAWINGS

The invention may take physical form in certain parts and arrangements of parts. The drawings are only for purposes of illustrating the preferred embodiments and are not to be construed as limiting the invention.

FIG. 1 is an elevational view of haircutting shears including the improvements of the present invention;

FIG. 2 is a plan view of FIG. 1 taken along 2—2 thereof;

FIG. 3 is an plan view taken along line 3—3 of FIG. 2;

FIG. 4 is a side view of the haircutting shears of FIG. 1;

FIG. 5 is a elevational view of an alternate embodiment of the shears of FIG. 1;

FIG. 6 is a plan view of the shears of FIG. 5 taken along line 6—6 thereof; and, FIG. 7 is a plan view of the shears of FIG. 6 taken along line 7—7 thereof.

DETAILED DESCRIPTION OF THE PREFERRED EMBODIMENTS

With reference to FIG. 1, a first blade A has a cutting edge 10 depending from a substantially smooth following edge 12. A pivot point 30 separates the cutting edge 10 and the following edge 12 from a handle 16. The handle 16 includes a grip 18 adapted for the placement of a finger therethrough. A second blade B includes a cutting edge 40 (FIG. 2) depending from a substantially smooth following edge 42. The pivot point 30 separates the cutting edge 40 and the following edge 42 from a handle 46. The handle 46 includes a grip 48 adapted similarly to the grip 18 of the first blade A for the placement of a finger therethrough. In the preferred embodiment, the grip 48 includes a support 50 adapted for the placement of a finger thereon. The first blade A and the second blade B are pivotably connected to one another at the pivot point 30 in a fashion to be further described below.

With reference to FIGS. 2 and 3, the cutting edge 10 of the first blade A is essentially perpendicular to the following edge 12. The cutting edge 40 of the second blade B is similarly essentially perpendicular to the following edge 42. The cutting edges 10 and 40 trace a generally sinusoidal cutting edge, and are placed so that the cutting edge 10 of the first blade A is complementary to the cutting edge 40 of the second blade B. The complementary cutting edges of the first blade A and second blade B are placed so as to intermesh, as best depicted by FIG. 2, when the first blade A and the second blade B are caused to pivot about the pivot point 30 (FIG. 1).

With continuing reference to FIGS. 2 and 3, the cutting edges 10 and 40 comprise base portions 52, 54 and cutting surfaces 56, 58, respectively. The cutting surfaces 52, 54 have an amplitude a. The amplitude a is such that it is less than one-half a combined thickness of the cutting edge 10 and following edge 12 of blade A or the cutting edge 40 and following edge 42 of blade B as depicted by b. When constructed in this fashion, the resultant blade A and blade B are lightweight and functional for haircutting.

The cutting edge 40 angularly projects from the following edge 42 along to effect a cutting surface distinct and spaced from the following edge. The cutting edge projection 42 is extant with the following edge and includes a base portion 52 depending from the following edge at the edge end adjacent the cutting edge 42. The base portion 52 in turn depends into the cutting surface 56 such that the haircutting accomplished at the cutting edge is spaced from the following edge by an extent defined by the dimension of the base portion. Accordingly, the cutting edge 40 comprises a cutting surface 56 having an amplitude a and a base portion 52.

Obviously, the cutting edge 10 of the opposite blade B is similarly configured to include a base portion 54 and a cutting surface 58 depending therefrom.

It is within the scope of the invention that the cutting edges can project from the following edges in a variety of angular configurations. Preferably, though the cutting edges project in a generally 90° angle from the following edge.

The sinusoidal cutting edges 10 and 40 work best when at least eight projections or wave cycles are present in each blade A and B. Lesser numbers of cycles tend to negate the effectiveness by increasing the liklihood of a stepped cut. Similarly, when numbers in excess of 20 cycles or projections are used, the cut again becomes essentially "smooth" and the effectiveness of the present invention is again lessened.

As depicted by FIGS. 1, 2, and 4, blades A and B include tips 34 and 36 respectively. The tip 34 is generally perpendicular to the cutting edge 10 as is the tip 36 to the cutting edge 40.

With reference to FIG. 4, the cutting edge 10 ends at recess 14 and the blade A is supported only by a continuation of the following edge 12. Similarly, the cutting edge 40 of blade B ends at recess 44 while support is provided by following edge 42 that continues until pivot point 30 has been reached. The recess 14 and the recess 44 serve to isolate the cutting edges 10 and 40 from the pivot point 30. Therefore, when the blade A is pivoted toward the blade B with hair to be cut in between, no cutting is accomplished by a region where no full interaction between cutting edge 10 and cutting edge 40 is present, thereby, eliminating the possibility of hair snag.

With reference to FIGS. 5, 6 and 7, an alternate embodiment of the present invention is presented. The alternate embodiment of FIGS. 5, 6 and 7 differs from that of the embodiment as noted above in that the sinusoidal cutting edges 10 and 40 of the embodiment of FIGS. 1 through 4 have been modified to now define a sawtooth cutting edge 60 of the first blade AA and 90 of second blade BB.

With specific reference to FIG. 6 and continuing reference to FIGS. 5 and 7, the cutting edges 60 and 90 are shown to be at essentially right angles to their corresponding following edges 62 and 92, as where those blades of the other embodiment (FIG. 2). This too results in a lightweight shear particularly adapted to haircutting.

The invention has been described with reference to alternate embodiments. Obviously, modifications and alterations will occur to others upon a reading and understanding of this specification. It is intended to include all such alterations and modifications insofar as they come within the scope of the appended claims or the equivalents thereof.

Having thus described my invention, I claim:

1. Haircutting shears comprising:

a first blade having a first end, a second end and a pivot point interposed between said ends;

said first end including a means for gripping said blade;

said second end including a first sinusoidally grooved cutting edge having at least eight wave cycles, and a smooth-surfaced following edge, said cutting edge angularly projecting from said following edge to define a cutting surface spaced from said following edge;

a second blade pivotally mounted to said first blade at said pivot point, said second blade including a gripping means and a second sinusoidally grooved cutting edge complementary to said first cutting edge and a second smooth-surfaced following edge disposed opposite said second sinusoidally grooved cutting edge so that said first cutting edge will mesh with said second cutting edge when said first and second blades are pivoted about said pivot point;

said sinusoidally grooved cutting edges incuding an amplitude which is less than one-half a distance between said smooth surface and peaks of said sinusoidally grooved edges;

an air gap between said first and second sinusoidally grooved cutting edges so that hair will not be left unsevered when said first blade is pivoted toward said second blade on said pivot point;

said first and second blades including a cutting edge base portion depending from said following edge into a cutting surface, said cutting surface being spaced apart from said following edge by an extend defined by said base portion; and, a first tip on said second end of said first blade and a second tip on said second blade, said tips being generally perpendicular to said smooth surfaced following edges.

2. The haircutting shears of claim 1 wherein said sinusoidally grooved cutting edges are further defined to be sawtooth-shaped.

* * * * *